US007587969B2

(12) United States Patent
Silvers

(10) Patent No.: US 7,587,969 B2
(45) Date of Patent: Sep. 15, 2009

(54) ASYMMETRIC FIREARM SILENCER WITH COAXIAL ELEMENTS

(76) Inventor: Robert Silvers, 26 Wiltshire La., Marshfield, MA (US) 02050

( * ) Notice: Subject to any disclaimer, the term of this patent is extended or adjusted under 35 U.S.C. 154(b) by 210 days.

(21) Appl. No.: 11/509,247

(22) Filed: Aug. 23, 2006

(65) Prior Publication Data

US 2007/0107590 A1 May 17, 2007

Related U.S. Application Data

(60) Provisional application No. 60/711,550, filed on Aug. 26, 2005.

(51) Int. Cl.
*F41A 3/78* (2006.01)
*F41A 21/00* (2006.01)

(52) U.S. Cl. ..... 89/14.4; 89/14.2; 89/14.3; 89/198; 42/1.06; 42/79; 181/223

(58) Field of Classification Search ..... 89/14.2, 89/14.3, 14.4, 198; 42/1.06, 79; 181/223
See application file for complete search history.

(56) References Cited

U.S. PATENT DOCUMENTS

| | | | | | |
|---|---|---|---|---|---|
| 4,291,610 | A | | 9/1981 | Waiser | |
| 4,530,417 | A | * | 7/1985 | Daniel | 181/223 |
| 4,584,924 | A | | 4/1986 | Taguchi | |
| 4,588,043 | A | * | 5/1986 | Finn | 181/223 |
| 4,907,488 | A | * | 3/1990 | Seberger | 89/14.4 |
| 4,974,489 | A | | 12/1990 | Fishbaugh | |
| 5,029,512 | A | * | 7/1991 | Latka | 89/14.4 |
| 5,092,223 | A | * | 3/1992 | Hudson | 89/14.2 |
| 5,164,535 | A | * | 11/1992 | Leasure | 89/14.4 |
| 5,476,028 | A | * | 12/1995 | Seberger | 89/14.3 |
| D415,812 | S | * | 10/1999 | Andrews et al. | D22/108 |
| 6,308,609 | B1 | * | 10/2001 | Davies | 89/14.4 |

(Continued)

FOREIGN PATENT DOCUMENTS

| | | |
|---|---|---|
| DE | 2 229 071 | 11/1973 |

OTHER PUBLICATIONS

Paulson et al., Silencer History and Performances, vol. 2 CQB, Assault Rifles and Sniper Technology (2002), p. 350, Table 7.3.

(Continued)

*Primary Examiner*—Bret Hayes
*Assistant Examiner*—Michael D David
(74) *Attorney, Agent, or Firm*—Darby & Darby

(57) ABSTRACT

The present invention relates to a silencer for reducing muzzle blast and noise of firearms or similar devices. The present silencer has a hollow cylindrical or other shape casing comprising front and rear end caps and an opening aligned along a longitudinal axis defining a passage for a projectile and propellant gases to emerge from the muzzle opening. A plurality of serially placed baffles of symmetrical or slanted orientation and intervening coaxial spacers are positioned within the casing and define a multitude of chambers among the baffles, spacers, and outer housing. The baffles shear propellant gases away from the projectile path and through openings or ports into additional chambers formed between the spacers and outer housing. The arrangement of baffles and spacers provides flow-impeding paths, dispersion, and controlled expansion of gases and lowers gas temperature to reduce audible noise and observable signature of the muzzle blast.

15 Claims, 6 Drawing Sheets

U.S. PATENT DOCUMENTS 6,374,718 B1 * 4/2002 Rescigno et al. ..... 89/14.4
6,575,074 B1 6/2003 Gaddini
7,073,426 B1 7/2006 White
7,325,474 B2 * 2/2008 Yoshimura et al. ..... 89/14.4
2005/0126382 A1 * 6/2005 Yoshimura et al. ..... 89/14.4

OTHER PUBLICATIONS

Paulson, *Special Weapons* (Aug 2004), pp. 68-75.

* cited by examiner

ASYMMETRIC FIREARM SILENCER WITH COAXIAL ELEMENTS

This application claims the benefit of priority under 35 U.S.C. § 119(e) to U.S. Provisional Patent Application No. 60/711,550, filed Aug. 26, 2005, which is hereby incorporated by reference in its entirety.

FIELD OF THE INVENTION

The present invention generally relates to firearms and similar devices, and in particular to an apparatus for suppressing the muzzle blast, attendant noise, and visible signature of a discharging firearm for the purposes of reducing detectability and/or for protecting hearing.

BACKGROUND

Suppressors for firearms, also known as silencers, generally operate to reduce the audible noise or sharp report of a firing weapon by means of reducing and controlling the energy level of attendant propellant gases. Generally, the techniques employed utilize a series of baffles which control and delay the flow, expansion, and exiting of propellant gases, forcing the propellant gases to pass through various temperature absorbent materials, or a combination of these or functionally similar techniques to reduce the temperature and abrupt discharge of propellant gases. The result achieved is a corresponding reduction in the noise produced by the exiting propellant gases.

Up to the present time, known silencers for hand firearms can be generally classified into two groups. In one group, the discharge and propellant gases that follow the bullet into the silencer are stored for a short period of time in a plurality of successive chambers which are closed to the outside. This produces a controlled expansion of the propellant gases through each chamber reducing their temperature and pressure. In a second group, at least a portion of the propellant gases are diverted to exterior coaxial chambers through a plurality of passages between inner and outer walls which is more complex, but can provide more opportunities to delay and cool the gases, and hence reduce the muzzle sound level.

The generic silencer baffle, used in the first group of silencers, is a flat disk with a cut-out for a bullet passage and resembles a washer from a hardware store. Other baffles are more complex cone or funnel shapes, or are shaped like a washer with a raised area around the bullet aperture to cause resistance to the passage of the propellant gases. The best of these are known as 'K' or 'M' baffles because their shape somewhat resembles those letters, and are used as the industry standard. Another type of baffle is an elliptical shaped flat baffle placed within the silencer body at an angle. This type of baffle is known as a 'slant' or asymmetric baffle. Waiser's use of slanted baffles (1981, U.S. Pat. No. 4,291,610) was perhaps the first instance of such a design and he positioned them in alignment about the longitudinal axis. Waiser, as well as a Russian design for the Makarov pistol, showed the baffles rotated with respect to the longitudinal axis with the head/toe in, or almost in, contact. Slanted asymmetric baffles have also been used by Taguchi (1986, U.S. Pat. No. 4,584,924,). Taguchi's patent specifies flat-faced slanted-baffles at 90 degree rotations around the longitudinal axis with respect to the previous baffle.

Sometimes silencers of any baffle style are combined with heat absorbing mesh or metallic pellets which have the problem of needing replenishment as they become clogged or worn out. To keep propellant gases from escaping with the bullet, the more efficient designs employ 'wipes' which are generally elastomer disks with an 'X' cut in the center to allow the bullet to pass. The downside of wipes is that service life is very limited to well under 100 shots.

Gaddini (2003, U.S. Pat. No. 6,575,074) has created a design of the second group of silencers by combining symmetric baffles with round coaxial spacers and cut-outs. Each spacer formed just one chamber between itself and the outer tubular housing.

Some silencer designs have made use of square tubing to simplify construction. German patent (DE-AS Patent No. 2,229,071) and Fishbaugh (1990, U.S. Pat. No. 4,974,489) uses square tubing that is not in contact with the outer tubular casing and does not form multiple chambers between the outer side of the square tubing and the inner side of the outer tubular casing. Fishbaugh uses square tubing sections as a frame for mounting baffles, which are rather symmetric in nature. Further, the square tubing in Fishbaugh is not in contact with the outer tube, and has a single divider forming just two coaxial chambers in the entire silencer.

Finally, White (2006 U.S. Pat. No. 7,073,426) discloses a combination of slanted baffles and round-tube spacers used in conjunction with a flat first baffle.

One or more disadvantages of previously known silencers may be eliminated by the silencer of the present invention.

SUMMARY OF THE INVENTION

The silencer of the present invention includes a hollow cylindrical or other shape casing having a front end cap and a rear end cap, each of which has an aligned opening along a longitudinal axis to define a passage for a projectile and propellant gases emerging from the muzzle opening of a firearm. The casing contains specially configured heat absorbent and heat conductive elements (e.g., baffles, spacers, baffle/spacer combined units, one or more monolithic modules serving the same function, and combinations thereof).

The principal object of the present invention is to provide a novel and improved firearm silencer. Another objective of the present invention is to provide a firearm silencer that diminishes noise at the muzzle which is caused by the sudden outgoing powder and propellant gas. Another objective of the present silencer is to reduce flash at the muzzle, including preventing flash from being visible (or substantially reducing visibility) when shooting in low light. Yet another objective of the present silencer is to reduce the pressure wave which comes from the gun barrel, including preventing or reducing the movement of vegetation and the hurling of dust and other materials in front and/or to the sides of the shooting location. This is important in military practice in order to conceal the position of the shooter.

In one embodiment, the present invention is a silencer for a firearm including a casing that includes: a rear end having an entrance opening, and a front end having an exit opening, such that the openings define a path for a projectile. The silencer also includes a monolithic module of at least one oblong slanted baffle with an aperture therethrough and a spacer. The module is held within the casing. The spacer is formed and positioned to define a projectile passage and at least one chamber bordered by the spacer and the casing. The spacer may be any shape, but is preferably not circular. For example, the spacer may include a planar wall with edges that contact the casing to define the chamber.

In another embodiment of the present invention, the module is replaced with slanted baffles and a spacer with at least one planar wall. As in the embodiment described above, the planar wall has edges that contact the casing to define a chamber and a projectile passage.

A further embodiment of the present invention includes at least two baffles and a spacer between them disposed within the casing. A first oblong baffle with an aperture therethrough is slanted at a first angle with respect to an axis of the tubular casing and a second oblong baffle, also with an aperture therethrough, is slanted at a second angle with respect to the axis of the casing. The first angle and the second angle are different, such that the baffles are set at different angles with respect to the housing. The spacer, which may have any shape is inset within the baffles, and provides additional strength and sound reduction. Similar to the embodiments above, the spacer may be formed and positioned to define a projectile passage and at least one chamber bordered by the spacer and the casing.

In any of the above embodiments, the spacer may be in the form of a polygonal tube. The spacer may include a cut-out forming an opening therethrough. If the spacer is adjacent a chamber, the opening provides a passage for gasses to enter the chamber. Any baffle within the silencer may also have a cut-out to form an opening. Similarly, the opening may provide a passage into an adjacent chamber, if one is present. Any chambers within the baffle may be bordered on either end by a baffle, or may be bordered by baffles on both ends.

The path formed through the silencer for the projectile may be non-centered with respect to the casing.

Any baffles included in the silencer may include a number of different features. The baffles may have a raised or recessed section, or both. The baffles may also have an arch shape such that they are either concave with respect to the front end, convex with respect to the front end, or curved in an S-shape. The aperture in the baffle may be of any shape and may also include a scallop. If there are a plurality of baffles, one of the baffles, preferably that nearest the firearm, may be a blast baffle having a different (e.g., steeper or shallower) angle with respect to the axis of the casing than any other baffles included in the silencer. The blast baffle may have a cone shape or be primarily flat. The blast baffle may also be generally symmetrical.

DETAILED DESCRIPTION OF THE INVENTION

The silencer of the present invention includes a hollow casing having a front end cap and a rear end cap, each of which has an aligned opening along a longitudinal axis to define a passage for a projectile and propellant gases emerging from the muzzle opening of a firearm. The casing may be a tubular casing. As used herein, the term "tubular" refers to an elongate structure with an outer wall and a hollow interior, wherein the cross-sectional shape of the structure may be any closed shaped, such as a curved shape (e.g., circle, ellipse, oval, or the like) or a polygonal shape (triangle, rectangle, square, pentagon, hexagon or the like).

The projectile referred to herein is frequently described as a "bullet" for illustrative purposes, but any suitable projectile may be used in accordance with the invention. The rear end cap has an entrance opening through which a bullet and discharge gases pass from the muzzle opening of the firearm. The front end cap has an exit opening that is aligned with the entrance opening of the rear end cap and defines a passage for the bullet and gases through the casing.

The casing is a hollow area integral to a firearm or firearm barrel serving the same purpose, and contains specially configured gas-retarding, heat absorbent, and heat conductive elements selected from baffles, spacers, baffle/spacer combined units, one or more monolithic modules serving the same function, and combinations thereof. These elements are serially disposed and mounted either concentrically or offset within a larger heat absorbent tubular housing. The larger heat absorbent housing forms a casement attachable to the muzzle of the firearm. From this configuration, the present silencer reduces the energy of propellant gases, thus achieving a corresponding reduction of associated firing noise and signature. Further, the silencer contains, delays, deflects, controls, and/or disperses gases associated with the firearm firing.

Figure 4:
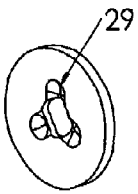
FIG. 4 shows an example of a symmetrical baffle with scallops.
Figure 10:
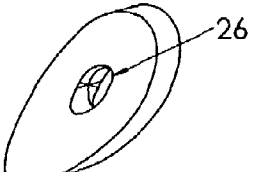
FIG. 10 shows a curved (arched) slanted baffle for more strength than a straight baffle of the same thickness. This baffle also has an optional nozzle.
Figure 9:
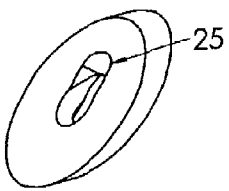
FIG. 9 shows a slanted baffle such as that in FIG. 5, with an optional scallop.

In a preferred embodiment, a majority of the full size baffle or baffles are oblong, slanted at an angle, and have openings larger than the caliber of the bullet to be passed therethrough. Accordingly, the silencer casing may include a plurality of approximately oblong baffles, which may have additional features on one or more surfaces or at the aperture area that provide a means for further directing, cooling, and/or impeding propellant gases. Examples of such additional features include, but are not limited to, scallops (29), as shown in FIG. 4 and/or steps on one or both sides of at least one baffle. These additional features may be located near or on the bullet passage aperture (on one or both sides), and may optionally be shifted sideways with respect to each other, on or near the bullet passage aperture, as a means for directing gas away from the bullet path. In one embodiment, one or more baffle has a special shaped nozzle profile (e.g., as shown in FIG. 10) that is added to the bullet passage aperture, as a means for directing, focusing diffusing, or impeding propellant gas flow. The bullet passage aperture, or some portion of it, of one or more baffle may be cut at an angle other than parallel to the bullet path axis. Additionally, the bullet passage aperture, or some portion of it, of one or more baffles may be cut at an angle other than perpendicular to the face of the baffle. Furthermore, baffles might have an arch shape for more strength against the action of propellant gasses without added thickness. The arched baffle may be convex or concave with respect to the front end of the silencer, or may be curved in an S-shape.

Figure 6:
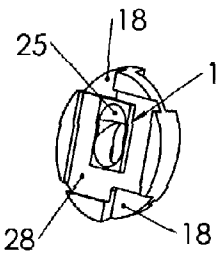
FIG. 6 shows an example of a preferred slanted baffle with cut-in areas, scallop, raised area, and inset area for holding a spacer.
Figure 15:
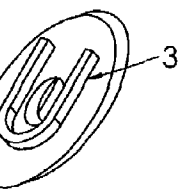
FIG. 15 shows the baffle in FIG. 5 with a "U" shaped propellant gas barrier.
Figure 16:
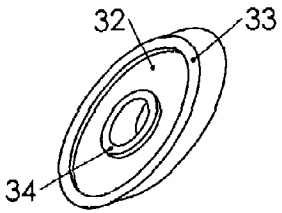
FIG. 16 shows the baffle in FIG. 5 with a "wall" shaped propellant gas barrier, a raised area, and an inset-area.
Figure 17:
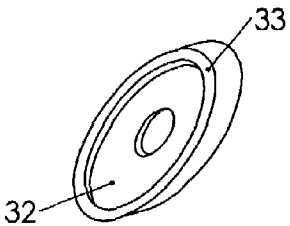
FIG. 17 shows the baffle in FIG. 16, but without the raised area.

In one embodiment, the baffle or baffles of the present invention have one or more cast, molded, machined out, raised, recessed, or removed areas on one or more sides (e.g., as shown in FIG. 6). These areas provide a means for supporting and further sealing gases to reduce or prevent escape from around the edges of a spacer, or as an optional raised area about the bullet aperture to delay passage, or to provide an additional place for optional cut-outs or cast or molded features that provide a means for allowing propellant gases to pass around the edge of a spacer. The cast, molded, machined out, raised, recessed, or removed areas may be shaped like ridges, shingles, steps, fish-scales, or the like (e.g., FIG. 11 and FIG. 14), and/or may include a "U" or "wall" shaped feature (e.g., FIG. 15). These areas may be located generally around the bullet passage aperture or completely or almost completely around the bullet passage aperture (e.g., FIG. 16), as an example of a means for providing additional surface area to further direct, cool, and/or impeded propellant gases. These areas may also be located around part or all of the circumference of the bullet passage aperture (e.g., FIG. 16 and FIG. 17), as an example of a means for providing additional surface area, strength, support, or area to weld to.

Figure 18:
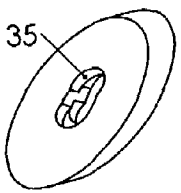
FIG. 18 shows the baffle in FIG. 5, but with a multi-stepped aperture.

One or more baffles of the present invention may include one side of the bullet passage aperture that is thinner than the other side, as an example of a means for enhancing diffraction of propellant gases around the thinner edge. One or more baffles may be shaped such that the portion near the bullet passage aperture is extended outward more than the average of the rest of the baffle face such that propellant gases generally travel first past the bullet aperture area before returning and passing through the aperture. One or more baffles may have cast, molded, raised, or machined out step or steps (e.g., FIG. 18) on or about bullet passage aperture, but with a multi-stepped aperture that may provide a thicker baffle with the gas diffraction ability that is normally only possible with a thinner baffle.

In another embodiment, the first one or more baffles include a shape selected from conventional 'K' and 'M' baffles, and baffles with one or more scallops on one or more sides on or about the bullet passage aperture. The first one or more slanted baffles may be at a different angle from perpendicular to the bore axis than one or more of the remaining baffles, or may be at differing angles along any axis from one or more of the remaining baffles. The first one or more baffles may be at differing spacing intervals from one or more of the remaining baffles. The first one or more baffles may have a larger bullet passage aperture than one or more of the remaining baffles, which might help accuracy by inducing less bullet yaw. Or may have a smaller bullet passage aperture than the one or more remaining baffles, which might help sound reduction while preventing a baffle strike. The first one or more baffles may have a tubular-shaped protrusion extending from the hole in the first baffle toward the firearm to protect the bullet from yaw-inducing propellant gases.

In another embodiment, the last one or more baffles include a shape selected from conventional 'K' and 'M' baffles, and baffles with one or more scallops on one or more sides on or about the bullet passage aperture.

In yet another embodiment, the front end cap has a scallop, scallops, or other external feature, as an example of a means for providing additional surface area and/or to further direct, cool, and/or impede propellant gases.

One or more baffles of the present invention may be manufactured from one or more materials selected from resins, polymers, steel, titanium, aluminum, and any alloy thereof.

In a separate embodiment, the baffles of the present invention, which have an improved efficiency and practicality, are combined with coaxial elements to further increase the total system efficiency. In this embodiment, the silencer includes a hollow tubular casing and front and rear end caps as in the prior embodiments. Additionally, the silencer includes, a plurality of oblong baffles and spacers (also referred to as coaxial spacers) which may be individual units, combined baffle/spacer units, or a larger assembly or assemblies of monolithic units, each having a passage opening or openings therein within the casing or within the firearm or firearm barrel. The passage opening(s) define one or more chambers between the baffles and one or more chambers between the coaxial spacers and outer casing. This silencer also includes a means for propellant gases to pass into chamber(s) formed between the coaxial spacers and outer casing.

In one embodiment, the bore axis is not centrally located so as to have an offset design. When the bore hole is not centered, the silencer provides for further sound reduction and less obstruction of sighting devices. In another embodiment, one or more but not all of the baffles are approximately perpendicular with the bore axis.

In another embodiment, the coaxial spacers are made from square tubing in contact with the outer casing to provide multiple sub-chambers between the flat sides of the square tubing and the outer casing of the silencer. The coaxial spacers may also be made from square tubing with corners not in contact with outer casing. Alternatively, the coaxial spacers may be made from other shaped tubing (e.g., round, oval, triangular, or any other suitable shape), or cast, molded, or machined from a material that resembles tubing. The coaxial spacers may also be made from multi-sided tubing with more than four faces.

The coaxial spacers of the present invention may have one or more holes (or cut-outs or nozzles) of any shape on one or more surfaces of the spacer, as an example of a means for allowing gas to pass through the spacer and be trapped within the space enclosed between the spacer surface and silencer outer housing; as an example of a means for allowing gas to reemerge into inner portion of spacers to cause turbulence when colliding the gas with other gas streams; as one example of a means for allowing water or other mediums added to the silencer for the purpose of increasing sound reduction to be stored within cavities formed between the spacers and silencer outer housing for a longer period of time than without such one or more holes (or cut-outs or nozzles); or as an example of a means for allowing water or other medium added to the silencer to be dispensed back into the gas flow by evaporation or propellant gas pressure. Further, the coaxial spacers of the present invention may have holes (or cut-outs or nozzles) of any shape that are at diagonally opposite sides, as an example of a means to create swirling of propellant gases and interference with other streams of gas.

In one embodiment of the present invention, the propellant gases pass through one or more channels in the baffles around the coaxial spacer walls into one or more outer chambers formed between the coaxial spacers and outer casing. The coaxial spacers may have one or more passages for propellant gases wherein one or more passages are profiled into a nozzle shape, as an example of a means to diffuse or concentrate propellant gas flow.

The coaxial spacers may have one or more passages for propellant gases, and one or more passages may be open to an edge on the spacers. The coaxial spacers may have one or more passages for propellant gases, and one or more passages that are along one or more corners on the spacers, as an example of a means for allowing the propellant gases to reach more than one cavity formed between the spacer surfaces and outer silencer casing. The coaxial spacers may have multiple passages for propellant gases wherein the passages are approximately at opposite ends of the spacers.

The baffles of the present invention may be at the same or differing angles from each other along any axis. The baffles may be of differing thicknesses. The baffles may be at differing distances apart and the spacers may have different corresponding lengths.

The internal structures (e.g., baffles, spacers, scallops, nozzles, cut-outs, raised areas, etc.) of the present invention may be cast, molded, machined, or manufactured into one or more monolithic units. The spacers and baffles of the present invention may be cast, molded, machined, or manufactured as combined baffle/spacer units.

In one embodiment, the baffles do not contact the silencer outer-tubular housing. In another embodiment, the baffles are part of the spacers and additional partitions are included within the silencer housing.

The baffles of the present invention may include the bullet passage aperture that is cut at an angle perpendicular to the face of the baffle. The baffles may have one or more steps cast, molded, or machined into them on one or both major sides, as an example of a means for supporting one or more edges of the coaxial spacers; or as an example of a means for enhancing diffusion or impeded flow of propellant gases.

The baffles and/or spacers of the present invention may be manufactured to mate against one another (e.g., the spacer may be angled to conform with the angle at which an adjacent oblong baffle is slanted); and to optionally mate against one another only in some areas as an example of a means for allowing gas passage through areas not in contact.

In one embodiment, the outer tubing is composed primarily of carbon fiber or other heat-conducting or composite material. In another embodiment, the baffles are composed primarily of carbon fiber, ceramics or other heat-conducting, heat-resistant or composite material. In another embodiment, the spacers are composed primarily of carbon fiber, ceramics or other heat-conducting, heat-resistant or composite material.

In yet another embodiment, the rear end cap is manufactured to mate to a firearm, and incorporates an attachment mechanism that facilitates rapid attachment or detachment.

Figure 11:
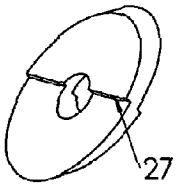
FIG. 11 shows the baffle in FIG. 5 with a step added onto each side.
Figure 12:
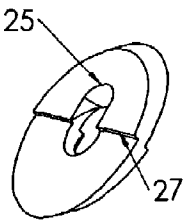
FIG. 12 shows the baffle in FIG. 11 with a scallop added to the front and/or back.
Figure 13:
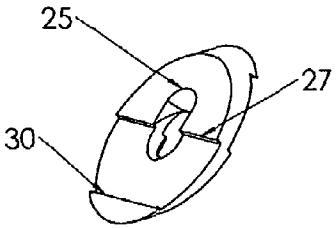
FIG. 13 shows the baffle in FIG. 12 with the addition of raised areas manufactured to provide support for a spacer such as that in FIG. 21.
Figure 14:
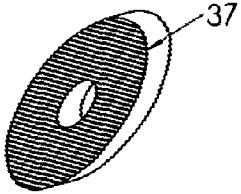
FIG. 14 shows an example of the baffle in FIG. 5 with a textured surface.

In still another embodiment, one or more baffles includes one or more steps or ridges, such as in FIG. 11 or FIG. 14, on one or more sides, as an example of a means to add surface area and/or direct, focus, diffuse, and/or impede propellant gas flow.

In another embodiment, the edges of the slanted baffles may be in contact with the outer casing. In another embodiment, the baffles are integrally formed as part of the spacers, or are otherwise connected to the spacers. The outer casing is optionally partitioned by additional components (e.g., washers, spacers, stand-offs, and the like) in order to create multiple sub-chambers. The baffles shear propellant gases at differing angles, forcing the gases away from the bullet path through openings or ports into the outer housing chambers. The arrangement of the baffles and the inner-coaxial spacers within the housing provide tortuous paths for gas flow, dispersion, and controlled expansion into and along spaces between the inner and outer housings. This arrangement also lowers the temperature of the gases to reduce audible noise and observable signature of the muzzle blast.

The opening in each baffle optionally has a profile to direct the gas flow at a desired angle to impede passage through the opening in the next baffle while simultaneously directing gas flow through ports in the spacer positioned between the current and following baffle such that the gas gets trapped between that spacer and the outer-housing wall, increasing the length of the path that the gas must flow through. This delays the progression of gases and causes them to cool at a greater rate, thereby lowering the gas pressure and noise upon release to the outer atmosphere. The specially configured baffles are made of heat conducting and/or heat absorbent materials (e.g. aluminum, chromium molybdenum (also known as "chrome moly"), stainless steel, ceramic, plastics, carbon-fiber, or other composites). The first baffle in the casing optionally has a longer spacer to define an initial expansion chamber for the gases, thus reducing their pressure. Successive baffles and spacers serially disposed repeat the process of shearing off gases, substantially eliminating the presence of any significant gas energy immediately behind the exiting projectile at the moment of firing. The channeled gases expand within intervening open spaces between the baffles inside the inner tubular housing, and into spaces defined by the inner and outer tubular housings. The gases are forced into such spaces by the shearing effect of the baffles and adjacent ports or openings in the inner tubular housing.

The first or more baffles are optionally slanted at less of an angle with respect to the longitudinal axis (i.e., are more perpendicular to the bullet passage) than the following baffles. This reduces or prevents the projectile from deviating from the point of aim by controlling the pressure of the powder gases that collide against the baffles. More specifically, this arrangement allows for less accuracy-decreasing yaw than if the first or more baffles were as radically asymmetrical as the following baffles. Alternately, the first or more baffles are optionally slanted at more of an angle with respect to the longitudinal axis, to provide for more aggressive propellent-gas redirection. Optionally, the first or more baffles are of the more symmetrical variety, such as the 'K' and 'M' baffles commonly known to those of ordinary skill in the art, or of the Tri-Scallop design as shown in FIG. 4. A silencer including a first or more baffles that are relatively symmetrical or Tri-Scallop, in accordance with one embodiment of the present invention, would likely be more accurate than a silencer incorporating a highly-asymmetric first baffle.

The placement of the baffles and spacers continues to rob energy from the muzzle gases as the gas flow changes its direction through these elements. Thus, the velocity of the gas flow is effectively diminished. Those baffles that are placed at an angle with respect to the longitudinal silencer axis have a larger surface area than those placed perpendicular to it. If the baffles are made of a good heat conducting or heat absorbent material, such as those materials described above (preferably, aluminum or carbon fiber), the propellent powder gases are effectively cooled while passing through the silencer so that less flame is created at the muzzle. The gas shearing, dispersal, expansion, and reentry process is repeated until the gases eventually exit by way of the internal axial passage provided for the projectile. Hence, the present silencer is highly advantageous because its assembly provides for greatly diminished energy, reduced noise, and negligible observable signature. In fact, the baffles of the present invention are particularly advantageous because they help to achieve significant noise reduction. In the present silencer, approximately 99.95% of the sound intensity generated by the discharging of the firearm is removed when measured at one meter from the 's muzzle.

In a preferred embodiment, the asymmetric baffles are separated by means of intermediate spacers placed within the housing. In this embodiment, the silencer can easily be dismantled for cleaning or service, or can be designed to be tamper-resistant in order to prevent disassembly by end-users. The manufacturing of the baffles and spacers is a simple process known to those of ordinary skill in the art. Therefore, the production costs of the silencer are reasonable, which provides yet another advantage to the present invention.

Other advantages of the present silencer relate to size and weight. Compared to the silencers in general use, the silencer of the present invention can be constructed smaller in size and lighter in weight for any given sound reduction level. As is the case with many commonly used silencers, the silencer assembly is large enough to hinder the operator's sighting ability through the aiming device(s) of the firearm being used. The present invention solves this problem by providing a silencer that may be constructed with a small diameter. These advantages are achieved by means of the structure and materials used in the present invention.

Another advantage is that the present silencer can enhance the accuracy of the host firearm, and can function in such a manner as to greatly reduce visible signatures, such as smoke and muzzle flash. Additionally, in one embodiment, the silencer provides improved efficiency by having coaxial chambers and a plurality of successive chambers formed by a set of serially placed baffles, and spaces formed between an inner coaxial spacer-wall and outer tubular casing, all of which provide more options for propellant gas control. In another embodiment, the overall assembly and gas flow pathways are advantageous because the present silencer includes a longer gas flow pathway that forces the propellant gas to travel over large internal surfaces of baffles. This pathway is established by increasing the angle of some internal baffles so that they are not perpendicular to the projectile axis, and also by diverting some portion of gas into additional chambers provided by the space between the outer casing and an inner coaxial tube. The inner coaxial tube can be of any suitable shape, such as square, round, triangular, or some other shape. In another embodiment, the present silencer optionally allows rapid gas entry into the coaxial chambers by having an entry point where a spacer contacts an adjacent baffle.

The baffles of the present silencer have further advantages. In one embodiment, the silencer includes thick baffles that are stronger and more easily welded to the outer tubular housing. These baffles still allow efficient propellant gas disruption and diffraction through the use of cast, molded, or machined holes, nozzles, and/or other features in and/or around the bullet aperture. In another embodiment, the present silencer includes steps and/or scallops near the bore on one or more baffles, and/or a nozzle-like shape on one or more baffles. These features provide a means for steering gas where desired for maximum disruption of flow and/or directing a greater portion of the gas into the next coaxial chamber and away from the path of the projectile. One or more of the baffles may include a curve, as an example of a means for reducing the likelihood that the baffle will bend under pressure.

The materials and manufacture of the present silencer are advantageous and may include internal components that can be cast, molded, or machined of metals, composites, plastics, carbon-fiber, ceramics, or other advanced materials. The present silencer may also include internal components that can store water or other mediums useful for cooling of propellant gases for extended periods of time. Further, the present silencer lends itself readily to fabrication for various calibers, or conversion from one caliber to another by means of substituting different preassembled "core" elements having internal passageways of appropriate size. In another embodiment, the present silencer allows for intentional alternative construction of the outer silencer tube or casing to accommodate coupling not only directly to a firearm barrel by means of threads, but also alternatively to special mechanical mating fixtures to allow for rapid attachment and removal. The present silencer may also be manufactured to be smaller and lighter, as desired, for any given noise output, or to have less noise output for any given size. In another embodiment, the silencer of the present invention has an economical construction and is either readily assembled and serviceable by others or deliberately difficult to tamper with.

Furthermore, this silencer may achieve a high level of effectiveness without the need to employ absorbent meshes or packing materials or the use of elastic "wipes," which must necessarily be cleaned or replaced after repeated usage. However, the present invention may be optionally fitted with inserts of such materials as an enhancement to normal operation to further moderate weapon blast and enhance sound reduction properties of the unit.

The present invention is next described, in part, with reference to the drawings. FIGS. 1*a*-1*c* shows an example of a preferred embodiment and the relationship of the baffles and spacers and includes a rear end cap (1), a front end cap (10), and an outer-tubular casing (2). The front and rear end caps have an aperture larger than a bullet such that a bullet and propellant gases could pass through. The front and rear end caps are in alignment such that a bullet passing through the aperture in the rear end cap may also pass through the aperture in the front end cap. For a rifle-caliber silencer, all parts are best made of 300 series stainless steel. Preferably, the outer-tubular casing is bead-blasted for cosmetics and improved heat-dissipation and painted with an oven-cure dry-film lubricant such as a high-temperature Moly firearms finish. The rear end cap is threaded to fit the barrel of the rifle it is attached to. The thread size is commonly ½-28 threads-per-inch to fit the majority of military-caliber rifles. Preferably, the housing is approximately 6 inches long and approximately 1.5 inches in diameter to work best within commonly-accepted size limitations. The preferred thickness of the outer tube is approximately 0.065 inches.

Within the housing there is one or more baffles (4, 6, 8) and spacers (3, 5, 7, 9). Preferably, the baffles are ⅛ inch thick, are angled to create a radically asymmetric pattern, and are interspaced with the spacers which are 1/32 inch thick. In a preferred embodiment, the distance between baffles, and hence the length of the spacers, is one inch. The angle of the sides of the spacers that are in contact with the baffles is matched to the angle that the baffles are designed to slant within the outer tubular casing (2) (also referred to as the casing, housing, or outer tubular housing). The angle used does not need to be fixed, and instead could be different for each baffle/spacer combination. For the sake of bullet accuracy, it is preferable to use less of an angle at first and then more of an angle as the gases lose strength. The preferred angles are 15° for the first oblong baffle, 30° for the middle baffle, and 60° for the final baffle.

Preferably, the spacers are made from square tubing or a cast, molded, or machined element similar to square tubing because it can be made to fit snugly within the outer-tubular casing (2) and be self-supporting. This spacer construction allows for welding or affixing to the outer tube, and naturally forms more than one chamber or cavity between the outside of the spacer and the inside of the outer tubular casing (2) because the corners of the square tubing contact the outer tube in four places. Round tubing or similar could also be used, provided that it is either welded or otherwise affixed to one or more of the adjacent baffles or to a standoff collar or other means for holding the tubing away from the outer tubular casing (2) in either a central or offset location.

A rear end cap (1) provides a means to seal the outer-tubular casing (2) as well as a method to affix the silencer to the muzzle of a firearm. For example, threads on the rear end cap (1) may screw onto an appropriately-threaded barrel on the host firearm. Other means of attachment, such as interrupted threads, a bayonet mount, coarse ACME threads, or a snap-on mechanism may also be used. The rear end cap (1) and the front end cap (10) are threaded to the outer-tubular casing (2) using fine threads, such as a pitch of 1.4×32, and preferably sealed with a high-temperature thread-locking compound or welded.

Figure 19:
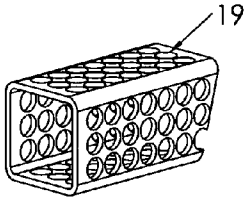
FIG. 19 shows an example of a spacer with a pattern of cut-out areas.

Within the silencer there is a spacer (3) which provides a coaxial element for the initial expansion of the propellant gases. This spacer can be an individual part or can be manufactured as integral to the rear end cap (1), and serves the added purpose of keeping the remaining silencer parts in place. This spacer is preferably used with a plurality of holes or cut-outs (19), as shown in FIG. 19, to allow for propellant gases to be diffused, disrupted, or to pass between the spacer and outer tubular casing (2). In addition, chambers or cavities formed between this spacer and other components may be used to store water or other mediums which will increase the sound-level reduction or improve the quality of sound upon firing. If this spacer (3) is not used, then the first baffle (4) (also referred to as the blast baffle) could be welded, screwed in place, or retained with a locking-ring or encapsulator to keep the other silencer elements restrained. The spacer and all other square tubing parts are preferably cut from longer sections of square-tubing using a saw, wire-EDM, water-jet, laser, or other cutting machinery.

While 300 series Stainless Steel is perhaps the best material for the military-rifle version in this example, other materials may be used, particularly for special applications. Examples of preferred materials of the silencer components are 316 stainless steel (if strength and corrosion resistance is the goal), chrome-moly steel (if strength and low cost are the goals), Nickel-alloy steel (if high-temperature resistance is the goal), Titanium alloy (if light weight and high strength are the goals), and Aluminum alloy (if light weight and easy manufacturing are the goals). A general guideline of optional material selection is to provide high strength and temperature resistance as the silencer may reach over 1000° F. Other goals of material selection include easy machinability, low cost, light weight, high thermal conductivity, and high corrosion resistance. Carbon fiber, or other reinforced composite materials are also preferred, as they have many of the desired properties discussed above.

Upon firing of the gun, a bullet exits the muzzle of the firearm at speeds typically above 900 feet per second (fps) and generally lower than 4000 fps. Propellant gases, however, are expanding and can achieve much higher speeds. It is therefore preferred to not have the first baffle be radically asymmetric as it may induce yaw in the bullet and degrade accuracy. Preferably, one or more blast baffles (4) at a 0-15° angle (15° is preferred) are therefore used first to provide an initial expansion chamber between the baffle, the outer-tubular casing (2) and the rear end cap (1). An expansion chamber is useful because it lowers the pressure and temperature of the discharged propellant gases to a level which is beneficial to the function of the components in the remaining path through the silencer. This described baffle may also be a non-angled shape such as FIG. 4 (which has triple-scallops on each side to further diffuse the propellant gases). Alternatively, the baffle may be mildly asymmetric, such as the baffle shown in FIG. 6, which is slanted at 15° to help reduce bullet yaw introduced by baffles slanted at 45°. The 45° baffles provide more sound reduction because they are more radically asymmetric. However, these baffles have a greater chance of introducing yaw to the bullet, which might reduce accuracy. Having an initial baffle slanted at 15° is advantageous where the gases are moving more than twice as fast as the bullet (i.e., gases moving at about 6000 fps, and the bullet moving at about 3000 fps). Once the gases reach the first blast baffle, they are slowed down sufficiently to warrant more radically asymmetric baffles slanted at angles that are more efficient at reducing sound level. The first baffle may also have cast, molded, machined, or otherwise manufactured features which provide support for the surrounding spacers.

This blast baffle might also have one or more additional holes, cut-outs, or nozzles to allow for propellant gases to pass or be directed or diffused. The face of the baffle does not need to be flat. Rather, if it has a cone or cup shape, it will further cool and delay propellant gases without hurting the desired goal of preserving accuracy and providing an initial blast-chamber.

Figure 20:
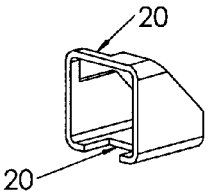
FIG. 20 shows an example of a spacer that may be placed between a non-slanted symmetrical baffle such as FIG. 4 and a slant baffle such as seen in FIG. 5. This example has gas-port cut-outs.
Figure 21:
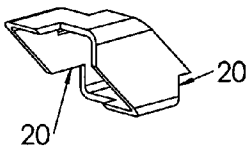
FIG. 21 shows a preferred example of a spacer with cut-outs.

As the propellant gases build in the blast chamber, they are lowered in temperature and pressure and, along with the bullet, proceed to the other side of the blast baffle (4) into chamber (16). In a preferred embodiment, the next component is a spacer (5) designed to support the blast baffle (4) on one side and the 'slant' baffle (6) on the other. This spacer is preferably made of square tubing because it can be fit to provide support against the outer-tubular casing (2) while still providing one or more chambers or cavities (15) between the spacer and outer casing. Other shapes such as triangular, hexagonal, round tubing, or a manufactured element approximating the same shape, can also be used. If round or oval tubing is used, only one or two coaxial chambers can be formed. Triangular tubing can form three chambers, and square tubing can form four. These four chambers may be made to resemble one or two chambers depending on if a path for propellant gases is connecting the chambers into fewer chambers. This spacer (5) preferably has cut-outs (20), shown in FIGS. 20 and 21, as a means for allowing propellant gases to pass into the described outer chambers as well as to store water or other mediums designed to further cool expanding gases. The length of this spacer should be at least long enough such that the next component, a baffle (6), does not interfere with the blast baffle (4). A length of about one inch is preferred. The length of the final spacer can optionally be optimized by sound testing on a specific firearm to determine which length is quietest. It is preferable to keep the outer tubular casing as short as possible because a shorter spacer is lighter, less costly, able to add less additional length to the completed firearm/silencer combination, able to reduce complications of alignment with the firearm bore, and is more appealing as a salable product.

Each spacer (other than the final spacer) is followed by an angled baffle (6). The baffles may be angled at about 10-65°, preferably at 45°. Shallower angles (less slanted) allow for more baffle/spacer combinations to fit within any length tubular casing. Steeper angles (more slanted) provide more sound level reduction for any fixed number of baffles and spacers, but require more length. Each baffle can be a different angle along any axis of rotation from any other baffle. Each mated spacer is designed to fit against the angle of the corresponding baffle, and the baffle is approximately sealed to the tube which contains it, although having holes, cut-outs, or ports along the edge of the baffle or spacer is possible.

Because the baffle is at an angle, the bullet can easily pass through the aperture while the propellant gases are forced to slide along the surface of the baffle. Because the surface area is larger than a baffle slanted at a more shallow angle (or than one not slanted at all), there is more area for the gases to contact and cool. As the gases travel along the path of the baffle surface, they compress and some of the gas reverses and causes turbulence or otherwise interferes with the original path of the gas, thus delaying gas flow and ultimately reducing the sudden release of pressure from the outlet muzzle in the front end cap (10) and hence lowering the gun-shot sound level.

Some of the gas which passes through the blast baffle (4) is diverted through cut-outs (20) in the spacer (5) and into chambers (15) before reaching the baffle (6). Other propellant gases are first affected by the baffle (5) before being diverted through cut-outs (20) and being passed into the cavity or cavities (15) formed between the spacer (5) and the outer tubular housing (2). Because these cavities exist, there are more opportunities for the propellant gases to be diverted, delayed, cooled, or otherwise impeded before further travel through the silencer than if the silencer did not have coaxial components.

Figure 1:
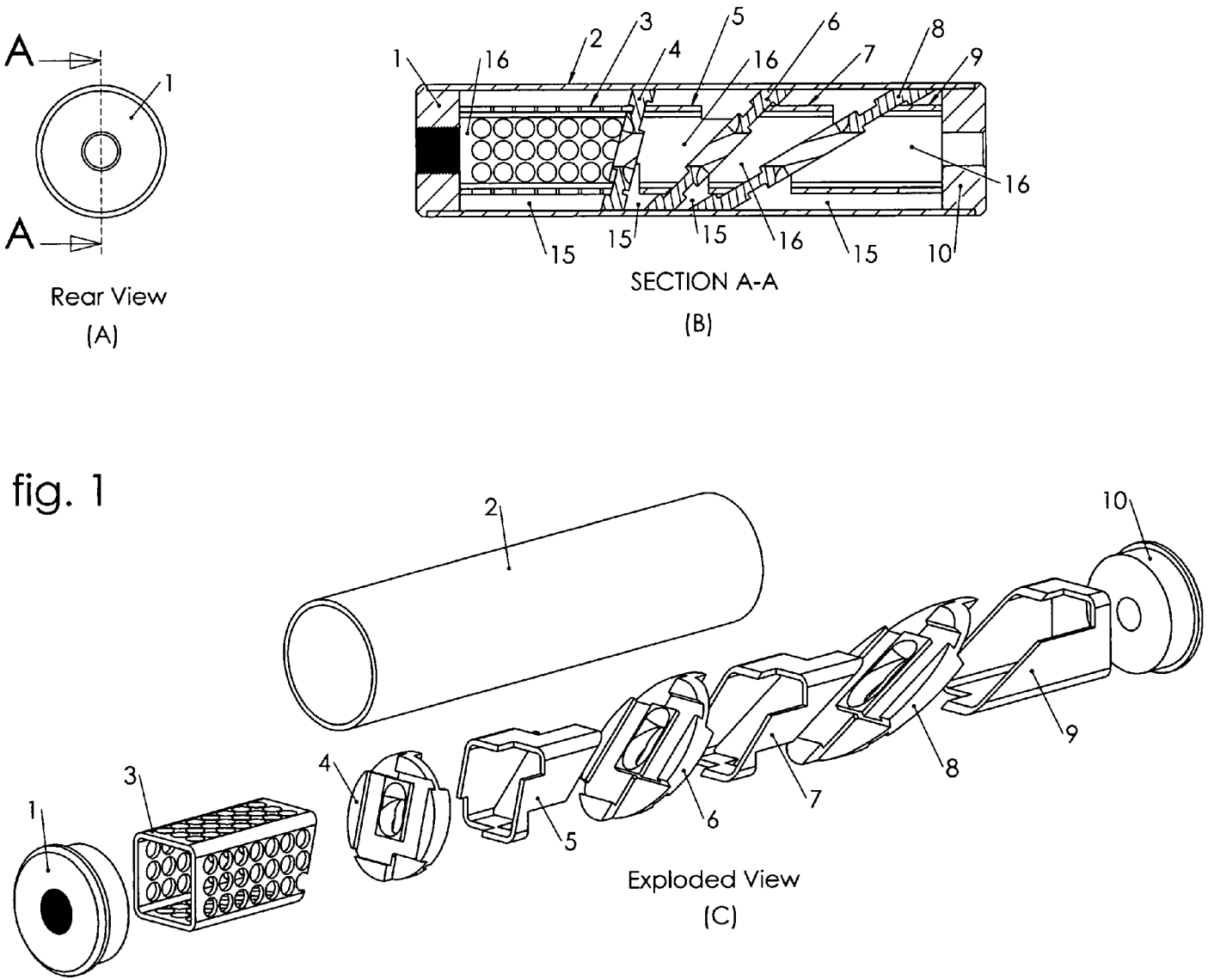
FIG. 1*a* shows a rear view drawing of a first embodiment of a completed silencer of the present invention.
FIG. 1*b* shows a side view sectional drawing of a first embodiment of a completed silencer of the present invention.
FIG. 1*c* shows an exploded drawing of a first embodiment of a completed silencer of the present invention.
Figure 7:
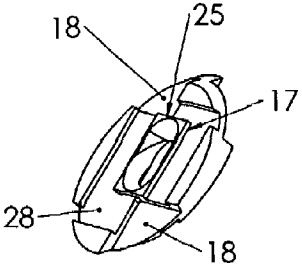
FIG. 7 shows the baffle in FIG. 6 but slanted at an alternate angle of 45°.
Figure 8:
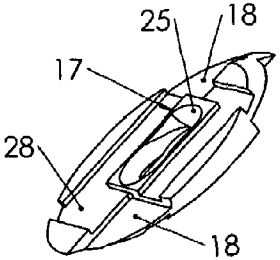
FIG. 8 shows the baffle in FIG. 6, but slanted at another alternate angle of 60°.

The slanted baffle (6) shown in FIG. 1 is shown alone in FIG. 7. As an alternative, any of the baffles shown in FIGS. 8-18 may also be used. The baffles may have scallops (25) added to the front and back near and connected to the bullet aperture such that the gas is further directed away from the bullet path. Some of these baffles have one scallop on each side, but more than one scallop is possible, as are other cut-out shapes. The baffles may also have cast, molded, machined out, or removed areas (28) on both sides which serve to support and further seal gases from escaping around the edges and also to provide an additional place to weld the baffle to adjacent spacers. The baffles may also include a step (27), an inset area (32), or a raised area either crossing the baffle (30) or around the baffle (33). The surface of the baffle may be textured (37) or have a propellant gas barrier thereon. Any combination of these features is also possible.

Figure 22:
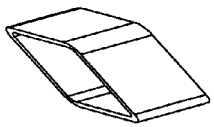
FIG. 22 shows a basic square-tubing spacer.
Figure 23:
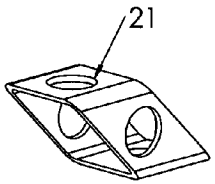
FIG. 23 shows the spacer in FIG. 22 with the addition of one cut-out in the center of each side.
Figure 24:
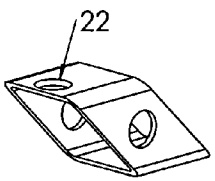
FIG. 24 shows the spacer in FIG. 22 with the addition of one or more cut-outs placed in each side but non-centered.
Figure 25:
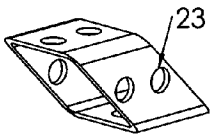
FIG. 25 shows the spacer in FIG. 22 with the addition of more than one cut-out placed in each side.
Figure 26:
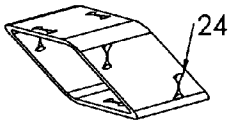
FIG. 26 shows the spacer in FIG. 22 with the addition of one or more nozzles placed in each side.
Figure 27:
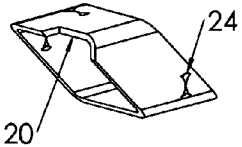
FIG. 27 shows the spacer in FIG. 22 with the addition of one or more cut-outs and nozzles.

The baffles may also be manufactured with the further addition of cast, molded, machined, or otherwise cut out areas (18) on one or both sides to allow for propellant gases to escape around the edge of a spacer that has no passages such as FIG. 22. Another advantage is that a variety of different baffles can be used, such as the baffle shown in FIG. 22, having no cut-outs of the preferred type (20), allowing for comparisons with spacers having cut-outs or cast, molded or manufactured features of various sizes without having to replace the baffles. This is not only useful for initial optimizing of this design for a specific application, but also when converting the design to other calibers or firearm models. Alternative spacers, such as those shown in FIGS. 23-27 may be used in place of that shown in FIG. 22. The sides of the spacer may include a single centered cut-out (21), non-centered cut-outs (22) or multiple cutouts (23). The spacers may alternatively include nozzles (24), or may include nozzles (24) in combination with cut-outs (20-23).

One advantage of having cast, molded, or machined-out areas in the baffles is that the edges of the baffle (4, 6, 8) can be thick enough (e.g., about ¼ inch) to allow welding to the outer-tubular casing and yet not have the disadvantage of a thick baffle which uses up more volume that could be better used to contain expanding propellant gases. There is a weight savings as well. Preferably, the edge of the baffle is about 5/32 inch, and the center is about ⅛ inch. The raised edge (17) around the bullet aperture remains to create a pressure boundary that makes it more difficult for the gas to pass through the aperture than if that area were not present. As propellant gases flow through the bullet aperture, they would tend to be directed by diffraction at an angle perpendicular to the face of the baffle. By adding one or more scallops, nozzle shapes, or other additional features (25, 26, 29, 31, 34, 35) to the bullet aperture, one can further direct or hyper-diffract these gases where desired to further impede their flow along the bullet path, which would increase turbulence and hence sound reduction.

For a special short-silencer with only one main slanted baffle (6), the propellant gases will pass through the final spacer (9) and then front end cap (10) before exiting the silencer. This final spacer does not need to be a discrete component but could be part of the front end cap (10) or cast, molded, or manufactured as part of the baffle (6). In fact, all components do not need to be individually made, and they could be cast or molded into one or more unitized pieces. In a preferred embodiment, there is another baffle (8) and additional spacers (7, 9) which alternate before finally terminating with the front end cap (10). The coaxial spacer (7) as drawn in FIG. 21 has sections removed or cast or molded in place which allow additional propellant gases to flow into the areas outside the wall of the spacer. These passages are best placed at opposite diagonal corners to increase the swirling of propellant gases and to further impede gas flow, delaying the gas propagation through the silencer to further cool and condense the gases, which results in less sound pressure output as they discharge from the front end cap (10).

Figure 2:
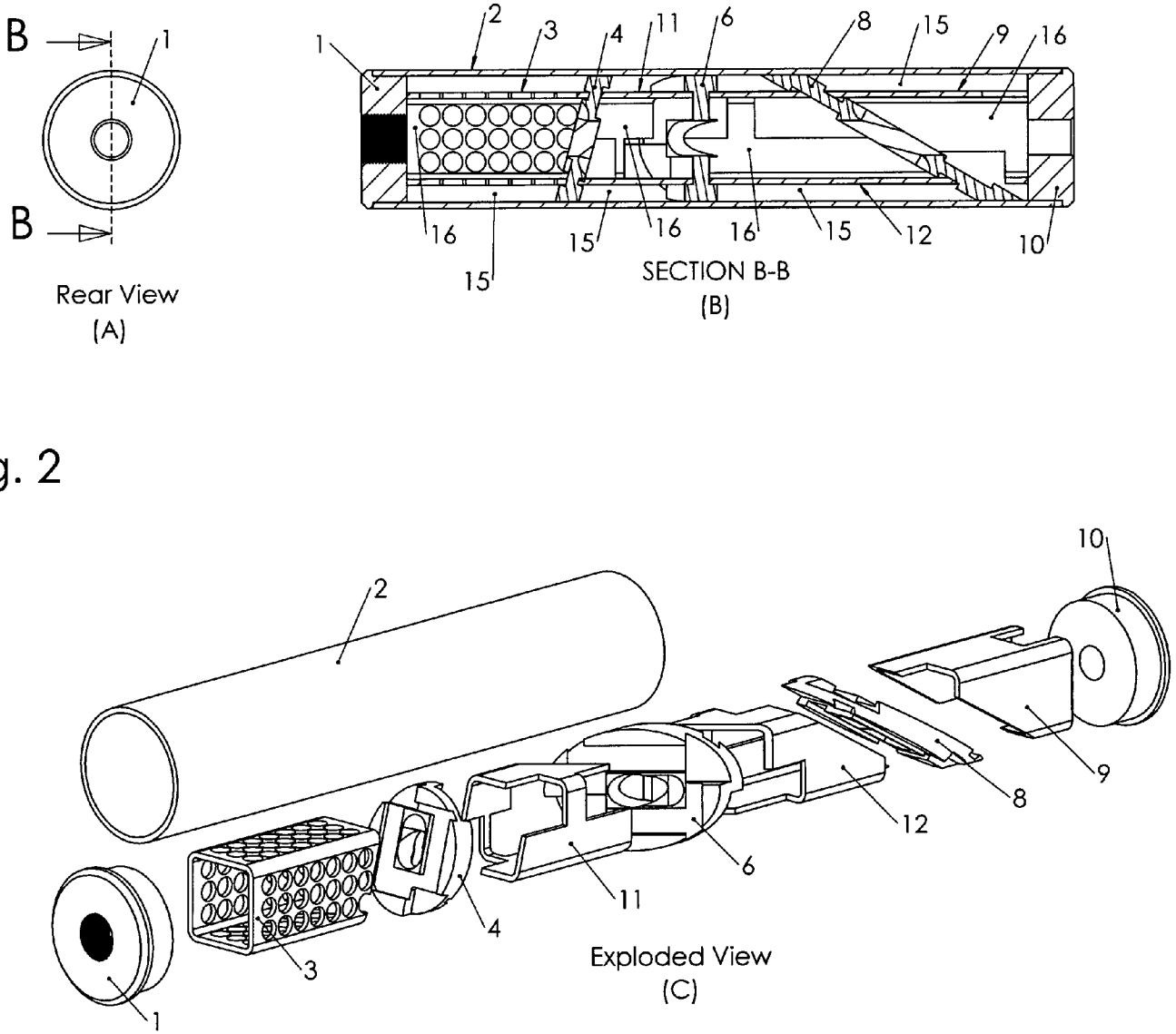
FIG. 2*a* shows a rear view drawing of a second embodiment of a completed silencer of the present invention.
FIG. 2*b* shows a side view sectional drawing of a second embodiment of a completed silencer of the present invention.
FIG. 2*c* shows an exploded drawing of a second embodiment of a completed silencer of the present invention.
Figure 29:
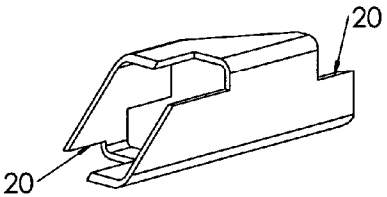
FIG. 29 shows a specific example of the spacer in FIG. 28 with cut-outs that provide a means for holding one adjoining baffle at an angle and with the opposite-side baffle being rotated with respect to the first baffle around the longitudinal axis and then slanted at an alternate angle with respect to the longitudinal axis.
Figure 30:
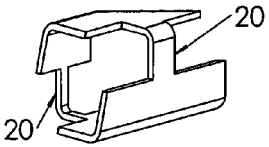
FIG. 30 shows an alternate specific example of the spacer of FIG. 29 with differing angles.

Another embodiment of the invention is detailed in FIG. 2, in which the difference from the preferred example in FIG. 1 is that the baffles (4, 6, 8) in FIG. 2 are rotated around the bullet path by some variable angle, shown in FIG. 2 as 90° from the previous baffle. This variation includes spacers (11, 12), which are positioned at a differing angle on each end and are detailed, for example, in FIGS. 29 and 30.

Figure 3:
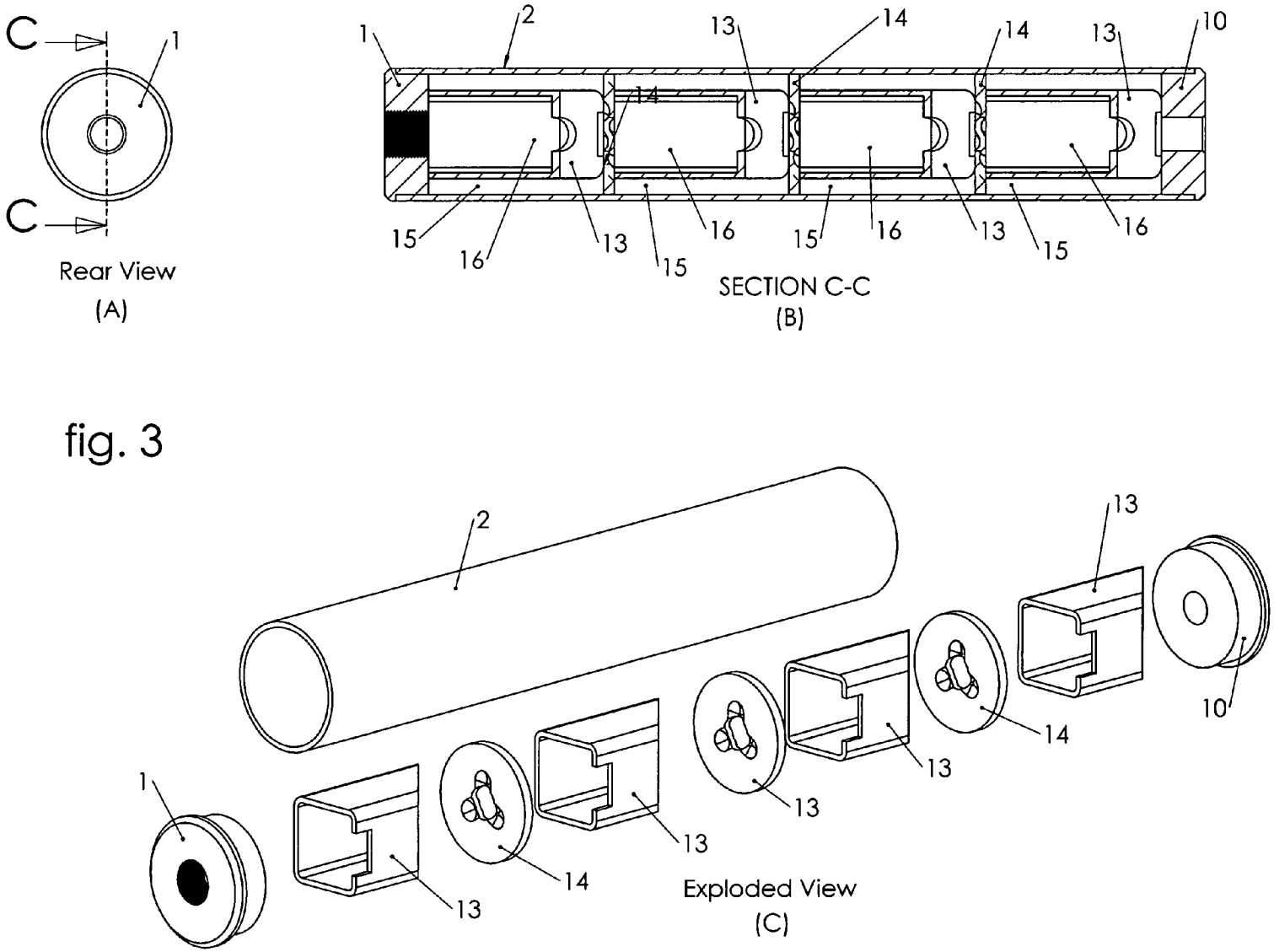
FIG. 3*a* shows a rear view drawing of a third embodiment of a completed silencer of the present invention.
FIG. 3*b* shows a side view sectional drawing of a third embodiment of a completed silencer of the present invention.
FIG. 3*c* shows an exploded drawing of a third embodiment of a completed silencer of the present invention.
Figure 5:
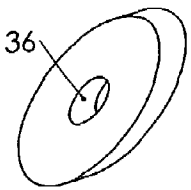
FIG. 5 shows a basic example of an asymmetrical slanted baffle with central bullet and gas aperture.
Figure 28:
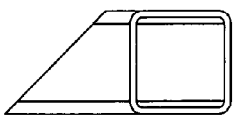
FIG. 28 shows a basic example of a spacer in which there is a differing angle on opposite sides.

FIG. 3 shows another embodiment which satisfies one or more of the objectives of this invention. Here, the spacers (13) are not open on both sides but have the exit sealed with an oblong surface except for the small opening of the bullet-path aperture. This is best seen in FIG. 3*b*. The reason for this design is to show that the oblong baffles do not need to, themselves, reach the outer tube (2) in order to function. In this embodiment, coaxial chambers are formed by the partitions (14). The spacer shown in FIG. 28 may be used as an alternative to spacer (13).

Figure 31:
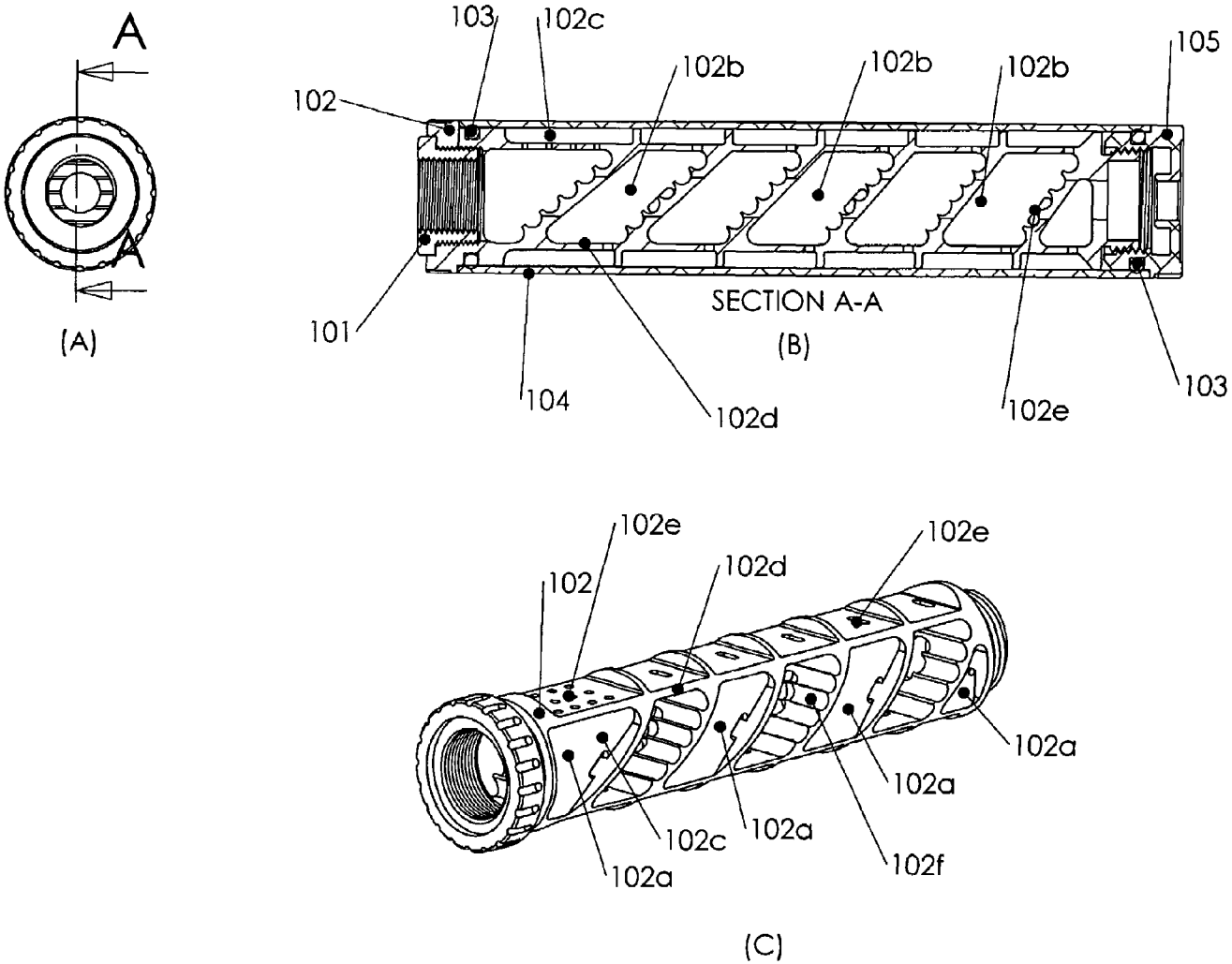
FIG. 31*a* shows a rear view drawing of a monolithic example of the present invention.
FIG. 31*b* shows a side view sectional drawing of a monolithic example of the present invention.
FIG. 31*c* shows an exploded drawing of a monolithic example of the present invention.

FIG. 31 shows a monolithic example where core (102) is the baffle module or modules; insert (101) allows for a muzzle interface made of a durable material; optional o-ring (103) allows for enclosure (104) to seal in gases; and end cap (105) holds enclosure (104) in place. As used herein, a "monolithic" part refers to a part that is formed from a single cast, molded, or machined out piece. Coaxial areas (102*c*) are formed around the core or cores (102). The coaxial areas are chambers between the core module and the tubular casing. To allow for easier manufacturing of a monolithic unit, each baffle (102*f*) has one optional sidewall which could be on either side (102*a*, 102*b*), shown here as alternating sides. Divider (102*d*), which serves as a spacer, divides a projectile passage from the outer coaxial area. Holes (102*e*) allow gases to pass to coaxial areas (102*c*). The divider 102(*d*) may be a planar wall, as shown in FIGS. 31*b* and 31*c*, or any shape defining a coaxial chamber.

A monolithic embodiment of a silencer of the present invention, as shown in FIG. 31, reduces sound by the same approximate mechanism as in the silencers shown in FIG. 1 and FIG. 2, but the monolithic embodiment includes a core (102), which is a monolithic baffle module. The advantage of manufacturing the baffles and spacers together (e.g., by machining, casting, laser or electron-beam sintering, molding, or other means) is to allow the end user to disassemble the product and put it back together more easily. Being able to take such a product apart allows easier cleaning and display of the internal features.

This monolithic embodiment has an insert (101) which allows for a muzzle interface made of a durable material (the core (102) may be a lighter and less durable material), and optional o-rings (103) that allow for enclosure (104) to seal in gases while end cap (105) holds the enclosure (104) in place. Coaxial areas (102*c*) are formed around the core (102). To allow for easier manufacturing of a monolithic unit, each baffle (102*f*) may be made with only one sidewall which could be on either side (102*a*, 102*b*); in FIG. 31 the sides alternate. In another variation, there are no sidewalls for easier cleaning and simpler manufacture. Holes (102*e*) allow gases to pass to coaxial areas (102*c*). Another embodiment is made by machining the core (102) from aluminum. Yet another embodiment is constructed by investment casting stainless steel. Die casting is preferred for volume production. Plastic or composite materials are expected to allow a weight savings. Note that if the unit is rotated 90°, 'sidewalls' would be on the top or bottom, so the orientation of the drawing is just for clarity.

Finally, the projectile-passage bore does not need to be in the center of the outer housing. It is sometimes desirable to offset the hole into an eccentric design which in some versions of the invention result in greater sound reduction and also allows for less or no obstruction of the firearm's sights.

EXAMPLES

The present invention is next described by means of the following examples. The use of these and other examples anywhere in the specification is illustrative only, and in no way limits the scope and meaning of the invention or of any exemplified form. Likewise, the invention is not limited to any particular preferred embodiments described herein. Indeed, modifications and variations of the invention may be apparent to those skilled in the art upon reading this specification, and can be made without departing from its spirit and scope. The invention is therefore to be limited only by the terms of the appended claims, along with the full scope of equivalents to which the claims are entitled.

The silencers of the present invention were sealed and the insides were not inspected. A 7.62 mm NATO military caliber firearm used in accordance with the present invention achieved 37 dbA net sound reduction with subsonic ammunition on a calibrated Bruel & Kjaer 2209 meter with a B+K 4136 microphone set for A weighting and peak-hold with the microphone placed one meter to the left of the muzzle as per MIL-STD-1474D. The very popular and high quality AAC Cyclone, used by the military and police agencies, achieved a net sound reduction of 30 dbA when tested at the same time. The tester had access to hundreds of silencers for comparison testing and was asked to pick out the quietest 7.62 mm silencer that he knew of. The tester selected the rather large (larger in both diameter and length than the silencer of the present invention) SCRC from famous maker Tim Bixler. This exceptionally quiet SCRC model, when tested at the same time with the same ammunition, scored a net reduction of 35 dB(A), which was 2 dB(A) less than the net reduction of the smaller silencer of the present invention. The greater the value of the net sound reduction, the better the silencer is at reducing sound levels. Each 3 dB reduction cuts the sound power in half. For comparison, the following results for other 7.62 mm silencers are published in a book by Al Paulson. Alan Paulson et al., Silencer History And Performances, Vol 2 Cqb, Assault Rifles And Sniper Technology (2002). The AWC Thundertrap, the industry standard benchmark, scored 30 dB(A) reduction with subsonic ammo. The Vaime Mk2, a slanted-baffle silencer, scored 22 dB(C) reduction.

Additional MIL-STD-1474D testing was performed, also with a B+K 2209 sound meter and subsonic ammunition, and documented the AAC Cyclone at 30.5 dB(A) and the 7.62 mm version of the silencer in this invention at 36.2 dB(A). These values are statistically equivalent to those reported above. Further testing showed the well-regarded SWR Omega 30 to score 29.6 dB(A), the military-adopted Ops Inc 3rd model at 24.3 dB(A), and the model currently-in-use in Iraq by the US Armed Forces Fisher Enterprises DC at 20.2 dB(A). Even a 1 dB(A) difference is something the ear can detect.

Additional tests were performed on a 5.56 mm NATO military caliber silencer. The unit was sealed and there was no internal inspection. Using 55 grain M193 ammunition, the most popular kind, the net sound reduction was 35.0 dbA. For comparison, the following numbers were published for the most popular products in an article by Al Paulson in an August 2004 issue of "Special Weapons." The highest performance silencer in the Paulson results, the AAC M4-2000, scored 33 dbA net sound reduction. The military-adopted KAC the M4QD scored 32 db(A) reduction. The very popular Gemtech M4-96D also scored 32 dB(A) reduction. These are the very best most competitive models in the industry. The other units that were reported in the Paulson article, including popular models used by the military, had several scoring in the 19-22 dB(A) range. However, the firearm silencer of the present invention demonstrates a clear, surprising, and substantial superiority over popular and conventionally used silencers.

All publications, patents, articles, and other references cited and/or discussed in this specification are incorporated herein by reference in their entirety and to the same extent as if each reference was individually incorporated by reference.

The invention claimed is:

1. A silencer for a firearm comprising:

a casing having an axis and including:

a rear end having an entrance opening, and a front end having an exit opening, each opening defining a path for a projectile;

a plurality of baffles disposed within the casing and each having an aperture therethrough, at least one of the baffles being an oblong baffle and slanted at an angle with respect to the axis of the casing such that a first end of the oblong baffle is disposed closer to the rear end than the aperture with respect to the axis of the casing and a second end of the oblong baffle is disposed closer to the front end than the aperture with respect to the axis of the casing; and at least one spacer extending from the oblong baffle to an adjacent baffle of the plurality of baffles, the spacer comprising at least one planar wall having two sides, each side being flush with the casing such that a chamber is defined between the planar wall and the casing and a projectile passage is formed opposite the chamber.

2. The silencer of claim 1, wherein the spacer is formed as a polygonal tube comprising a plurality of corners, each of the corners contacting the casing.

3. The silencer of claim 1, wherein the spacer includes at least one cut-out forming an opening between the projectile passage and the chamber.

4. The silencer of claim 1, wherein the chamber is bordered by at least the oblong baffle.

5. The silencer of claim 4, wherein the oblong baffle bordering the chamber includes a cut-out therein adjacent the chamber.

6. The silencer of claim 1, wherein at least one of the baffles has at least one of a raised section or a recessed section.

7. The silencer of claim 1, wherein at least one baffle has an arch shape such that it is either concave with respect to the front end, convex with respect to the front end, or curved in an S-shape.

8. The silencer of claim 1, wherein the baffle nearest the rear end of the casing is a blast baffle, the blast baffle having a different angle with respect to the axis of the casing than the angle of one or more of the plurality of baffles.

9. The silencer of claim 8, wherein the shape of the blast baffle is selected from cone shaped and primarily flat.

10. The silencer of claim 8, wherein the shape of the blast baffle is generally symmetrical.

11. The silencer of claim 1, wherein at least one of the plurality of baffles and the at least one spacer is a single piece.

12. The silencer of claim 1, wherein the oblong baffle is slanted at a first angle with respect to the axis of the casing, wherein another of the plurality of baffles is slanted at a second angle with respect to the axis of the casing, and wherein the first angle is different than the second angle.

13. A silencer for a firearm comprising:

a casing including:

a rear end having an entrance opening, and a front end having an exit opening, each opening defining a path for a projectile;

a plurality of baffles disposed within the casing and each having an aperture therethrough, at least one of the baffles being a planar oblong baffle slanted at an angle with respect to an axis of the casing and having at least a portion that is flush with the casing; and at least one spacer disposed within the casing adjacent the planar oblong baffle, the at least one spacer comprising at least one planar wall having two sides, each side being flush with the casing such that a chamber is defined between the planar wall and the casing and a projectile passage is formed opposite the chamber.

14. A silencer for a firearm comprising:

a casing having an axis and including:

a rear end having an entrance opening, and a front end having an exit opening, each opening defining a path for a projectile;

a first oblong baffle disposed within the casing, having an aperture therethrough, and being slanted at a first angle with respect to the axis of the casing such that a first end of the first oblong baffle is disposed closer to the rear end than the aperture with respect to the axis of the casing and a second end of the first oblong baffle is disposed closer to the front end than the aperture with respect to the axis of the casing;

a second oblong baffle disposed within the casing, having an aperture therethrough, and being slanted at a second angle with respect to the axis of the casing such that a first end of the second oblong baffle is disposed closer to the rear end than the aperture with respect to the axis of the casing and a second end of the second oblong baffle is disposed closer to the front end than the aperture with respect to the axis of the casing, the second oblong baffle being slanted in substantially the same direction as the first oblong baffle; and at least one spacer extending from the first oblong baffle to the second oblong baffle and comprising at least one wall having two sides adjacent the casing such that a chamber is defined between the wall and the casing and a projectile passage is formed opposite the chamber.

15. The silencer of claim 14 wherein the first oblong baffle, second oblong baffle and at least one spacer are a single piece.

* * * * *